US011554934B1

(12) United States Patent
Chiavarelli

(10) Patent No.: US 11,554,934 B1
(45) Date of Patent: Jan. 17, 2023

(54) DYNAMIC MULTI-HOIST LEVELING CONTROL SYSTEM

(71) Applicant: Agostino Saverio Mattoli Chiavarelli, Chile (CL)

(72) Inventor: Agostino Saverio Mattoli Chiavarelli, Chile (CL)

( * ) Notice: Subject to any disclaimer, the term of this patent is extended or adjusted under 35 U.S.C. 154(b) by 658 days.

(21) Appl. No.: 16/677,162

(22) Filed: Nov. 7, 2019

Related U.S. Application Data

(60) Provisional application No. 62/844,452, filed on May 7, 2019.

(51) Int. Cl.
*B66B 5/00* (2006.01)

(52) U.S. Cl.
CPC ..... *B66B 5/0018* (2013.01)

(58) Field of Classification Search
CPC .... B66C 1/28; B66C 1/30; B66C 1/68; B66C 13/04–063; B66C 13/10; B66C 13/105; B66C 13/18; B66C 13/22; B66C 13/23; B66C 13/30; B66C 13/38; B66B 1/24; B66B 1/28; B66B 1/30; B66B 1/3492; B66B 5/00; B66B 5/0006; B66B 5/0018; B66B 5/0031; B66B 5/12; B66B 5/125; B66B 7/10
See application file for complete search history.

(56) References Cited

U.S. PATENT DOCUMENTS

| | | | | |
|---|---|---|---|---|
| 4,883,184 | A | 11/1989 | Albus | |
| 5,645,181 | A * | 7/1997 | Ichiba | B66C 13/46 212/281 |
| 6,280,119 | B1 | 8/2001 | Ryan et al. | |
| 6,631,816 | B1 | 10/2003 | Miyazawa et al. | |
| 7,267,240 | B2 | 9/2007 | Maurer et al. | |
| 10,793,409 | B2 * | 10/2020 | Unger | B66F 7/16 |
| 2021/0122615 | A1 * | 4/2021 | Rauscher | B66C 13/063 |

* cited by examiner

*Primary Examiner* — Christopher Uhlir
(74) *Attorney, Agent, or Firm* — Malloy & Malloy, P.L.

(57) ABSTRACT

A system structured to transport a load carrying structure along the vertical direction while maintaining a substantially horizontal orientation thereof. A lifting assembly includes at least one lifting devices movably connected to the load carrying structure via a corresponding hoist line. The lifting device is configured to control the hoist line to accomplish raising or lowering of the load caring structure. A detection assembly, including at least one inclinometer determines an angle of inclination of the load carrying structure during the vertical travel thereof. A control assembly is operatively associated with the lifting assembly and the detection assembly to adjust the operative speed of the lifting device and length of the hoisting line upon a determination of an angle of inclination of the load carrying structure deviating from a predetermined angle of inclination indicative of a level orientation of the load carrying structure.

20 Claims, 3 Drawing Sheets

DYNAMIC MULTI-HOIST LEVELING CONTROL SYSTEM

BACKGROUND OF THE INVENTION

Claim of Priority

The present Non-Provisional patent application claims priority pursuant to 35 U.S.C. Section 119(e) to a currently and prior filed Provisional patent application, namely, that having Ser. No. 62/844,452 filed on May 7, 2019, the contents of which is incorporated herein by reference in its entirety.

FIELD OF THE INVENTION

The present invention is directed to a system for moving or transporting a load along a substantially vertical path of travel, including the raising or lowering thereof, while concurrently assuring the stability of such load by maintaining a supporting load carrier in a substantially level or horizontal orientation.

DESCRIPTION OF THE RELATED ART

Traditionally, load transporting units have incorporated hoisting components that generally do not allow for loads to be transported evenly along the vertical direction. This often occurs with systems that incorporate motorized components that can control two or more cables attached to different sides of load carrying components, such as for example platforms that may transport loads. With existing load transporting units, differentials in the vertical displacement between the different sides of the load carrying components can become significant over longer distances of vertical travel. This is typically due to the fact that it is difficult for separate pieces equipment, such as winches, to perform identically, whether or not the structural and operative features of the winches or other lifting equipment are identical. In turn, the load and the support on which it is disposed may deviate from a preferred level or horizontal orientation and assume an undesirable angle of inclination. Accordingly, many existing load transporting units are not ideal for moving loads over extended vertical distances, as may be required in many practical applications including, but not limited to, mining operations. Therefore, it is not uncommon to render a load and the support on which it is mounted unstable, in terms of maintaining a preferred, substantially level or horizontal orientation thereof when being transported along a vertical path, including the raising or lowering thereof. As should be apparent the instability of a load due to an undesirable angle of inclination of the support on which it is mounted may jeopardize the stability of the load, possibly resulting in loss or damage to the load as well as safety concerns to individuals in the corresponding proximity.

Accordingly, there is a need in this industry to provide a load transporting system that may maintain a substantially level or horizontal orientation of a load carrying structure or platform and the load supported thereon, when it is being either raised or lowered along a vertical path of travel. A benefit would be realized by providing a load transporting system that could accurately and reliably reduce the inclination of the load carrying structure by adjusting the speed of one or more supporting hoist lines attached to the load carrying structure. In addition, problems and disadvantages of the type set forth above and long recognized in the prior art associated with the use of conventional load transporting devices may be overcome if different supporting hoist lines, cables, etc. could be independently regulated or controlled in an effort to more effectively establish the preferred level or horizontal orientation of the load caring structure. Therefore, an improved and proposed load transporting system would overcome the disadvantages existing in this industry in an even more effective manner by at least partially automating the stabilization of the load caring structure and the support load through the recognition of an undesirable angle of inclination thereof and adjustment of the hoist lines, cables, etc. to establish the preferred, substantially level or horizontal orientation thereof.

SUMMARY OF THE INVENTION

The present invention is directed to a load transporting system that may be implemented in connection with a variety of applications such as, but not limited to, mining operations. As such, the load transporting system of the present invention is operative to vertically position or move any of a one or more of a plurality of different types of loads. Further, it is within the intended scope of the present invention that the inventive load transporting system assure a stability of the load being supported by maintaining a substantially level or horizontal orientation of a load carrying structure on which the load is supported.

Accordingly, the load transporting system of the present invention comprises a lifting assembly, a detection assembly, and a control assembly. The lifting assembly generally comprises a plurality of at least two lifting devices connected to the load carrying structure, on which the load is supported, via separate hoist lines or cables. For example, each load lifting device may be a motorized winch connected in movable supporting relation to the load carrying structure by a separate, independent hoist line. Each lifting device is generally structured to control movement of the hoist line, upwards or downwards, in a substantially vertical direction. The lifting assembly may also comprise more than two lifting devices to accomplish the vertical travel of the load carrying structure, while maintaining a substantially level or horizontal orientation thereof. For example, different ones of the plurality of lifting devices may be connected to the load caring structure at different, spaced apart locations, which may be substantially oppositely disposed relative to one another such as, but not limited to, different sides, ends, corners, etc.

The detection assembly is configured to determine an angle(s) of inclination of the load carrying structure as the load carrying structure is hoisted upwards or downwards. Accordingly, the detection assembly may comprise one or more inclinometers, each capable of determining a horizontal orientation and/or level of inclination which may vary from a substantially level or horizontal orientation. Therefore, the one or more inclinometers may be cooperatively disposed on the load carrying structure, preferably in separated or spaced relation to one another and are each structured to determine an angle of inclination of the load carrying structure with respect to a horizontal plane. Accordingly, each of the one or more inclinometers is disposed in an intended location in order to independently and/or collectively determine the angle of inclination. By way of example, two or more inclinometers may also be substantially oppositely or otherwise cooperatively disposed on the load carrying structure in respective locations which assure the accurate determination of the angle of inclination of the load caring structure. Further by way of example, a first inclinometer may be disposed on one side or end of the load carrying structure, whereas a second inclinometer may be disposed on an opposite side or end of the load carrying structure. As a result, disposition of the load caring structure out of a preferred level or horizontal orientation would be substantially concurrently indicated by both of the first and second inclinometers.

The aforementioned control assembly of the load transporting system of the present invention may comprise at least one control device but, in many practical applications, at least two control devices, wherein each control device is operatively associated with at least one transmitter and at least one receiver. Further, each control device is operatively connected to the corresponding receiver and to a corresponding lifting device. The transmitter is preferably, but not necessarily, disposed on the load carrying structure, generally in communicative proximity or relation to a corresponding inclinometer. However, the transmitter and the inclinometer operatively associated therewith may be disposed at different locations or positions relative to one another than in immediate physical proximity. The control device and/or receiver may be disposed in proximity to the lifting device, which will generally be at a higher elevation with respect to the load carrying structure. Accordingly, the control device may be configured to adjust the velocity of a corresponding hoist line by adjusting the rotational speed, in either direction, of a driving or lifting device, such as a winch. For example, the control device may be configured to adjust a velocity of the hoist line as it is being wound, or alternatively, as it is being unwound, for example by the driving winch. Such adjustment in the velocity of the hoist line, will result in a corresponding adjustment in the velocity of the load carrying structure, as well as a level or horizontal orientation of the load caring structure. Generally, each one of the inclinometers is operatively connected to a corresponding transmitter. If the inclinometer(s) determine that the angle of inclination of the load carrying structure has exceeded a predetermined value, the transmitter(s) is configured to transmit a signal to a corresponding receiver. When the receiver(s) obtain the signal from the transmitter(s), indicating that the true angle of inclination of the load caring structure deviates from or is not notably equivalent to a preferred predetermined angle of inclination of substantially 0°, the control device(s) is configured to adjust the velocity of the hoist line by controlling operation of the lifting device. However, it is within the intended spirit and scope of the present invention to utilize a single transmitter disposed in operative communication with both inclinometers.

It is emphasized herein that the terms "predetermined threshold value" and "predetermined angle of inclination" are meant to define an angle of inclination of the load carrying structure which approximates 0°, wherein a 0° angle of inclination of the support structure is indicative of a substantially level or horizontal orientation of the load carrying structure. It is further emphasized that the level or substantially horizontal orientation of the load carrying structure does not have to assume a precisely 0° angle of inclination. Minor variations from a 0° angle of inclination may still result in a sufficiently level or horizontal orientation, necessary to maintain the stability of the load being supported on the load caring structure during vertical travel.

The following example of the system according to the present invention comprises a lifting assembly with a first and a second lifting device, respectively connected to a first and a second hoist line; a detection assembly comprising a first and a second inclinometer; and a control assembly comprising a first and a second control device, a first and a second transmitter, and a first and a second receiver. In this example, the first hoist line controls vertical movement of the load carrying structure around a first end thereof, whereas a second hoist line controls vertical movement of the load carrying structure around a second and opposite end thereof. Generally, an initial vertical displacement of the load carrying structure may not necessarily alter the substantially horizontal orientation of the load carrying structure, but as such vertical displacement increases, the load carrying structure may begin to develop an angle of inclination relative to the horizontal plane. This may occur given that it is difficult for two separate lifting devices to perform identically, i.e., controlling movement of its corresponding hoist line at exactly the same speed. Thus, if the angle of inclination of the load carrying structure around the first end exceeds or falls below a predetermined or threshold value, the first control device may regulate operation of the first lifting device to adjust the speed of the first hoist line such that the orientation of the load carrying structure may return to a substantially horizontal orientation. More specifically, if the first angle of inclination exceeds such predetermined or threshold value, this would generally mean that the first hoist line has been displaced a vertical distance that is less than that of the second hoist line. As such, the first control device may regulate operation of the first lifting device so that the speed of the first hoist line is increased, thereby compensating for the difference in vertical displacement between the two hoist lines. As a result, the load carrying structure may gradually reassume a substantially horizontal orientation. It is also possible, although not strictly necessary, that the second control device also regulate operation of the second lifting device to decrease the speed of the second hoist line, also compensating for the difference in vertical displacement between the two hoist lines. Thus, the speed of the first and second hoist lines may be adjusted concurrently. That is, upon the angle of inclination exceeding the threshold value, the speed of the first hoist line may be increased and the speed of the second hoist line may be decreased at the same time. However, this is not strictly necessary as adjusting the speed of either the first hoist line or the second hoist line may generally be sufficient to account for a difference in vertical displacement between the two hoist lines. It is within the scope of the present invention that the similar adjustments, i.e., increasing the speed of the second hoist line and/or decreasing the speed of the first hoist line, be done if the angle of inclination of the load carrying structure around the second end of the load carrying platform is exceeded.

BRIEF DESCRIPTION OF THE DRAWINGS

Like reference numerals refer to like parts throughout the several views of the drawings.

DETAILED DESCRIPTION

Figure 1:
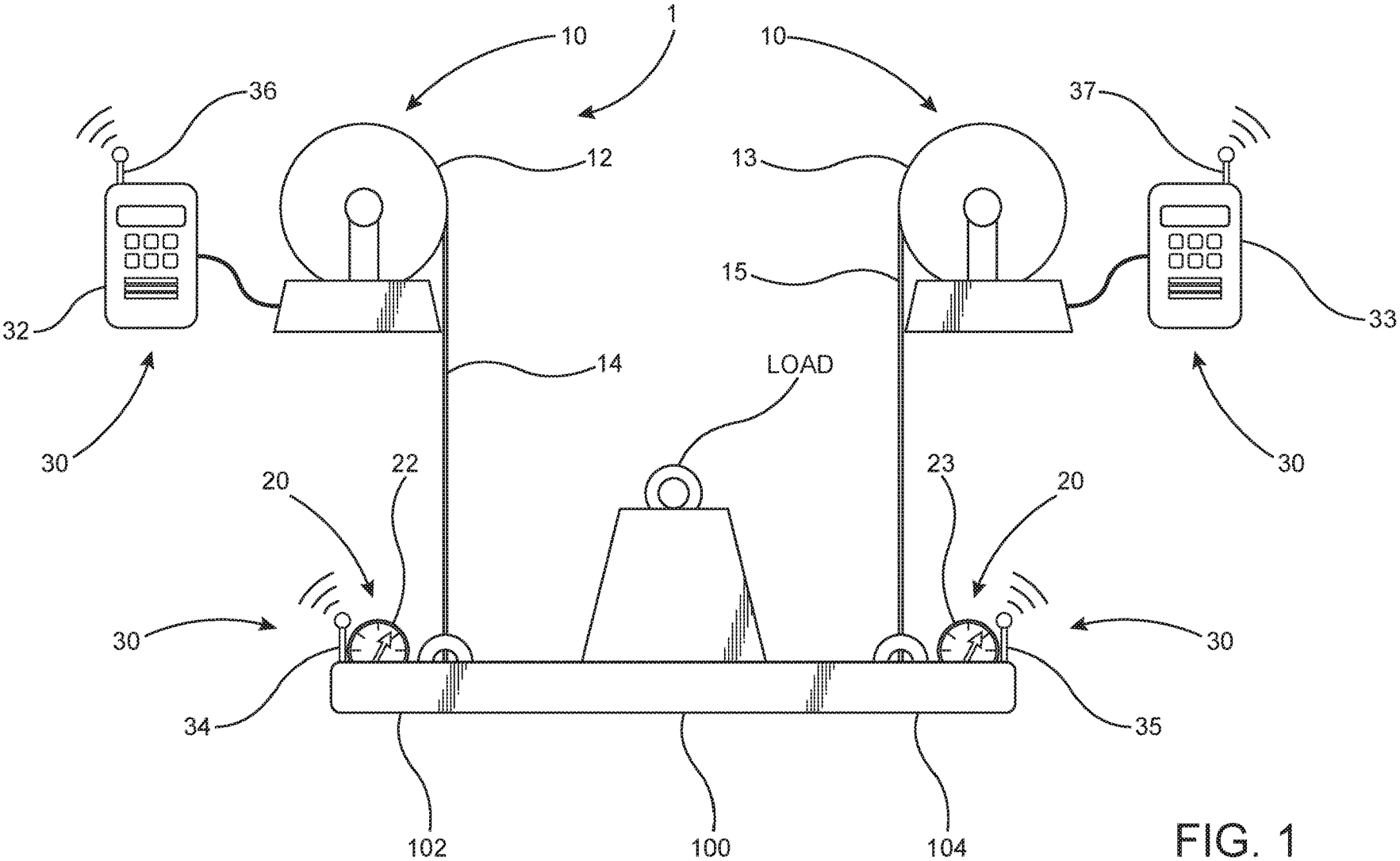
FIG. 1 is a schematic representation of one embodiment of a system according to the present invention with a load carrying structure having a substantially level orientation.

With initial reference to FIG. 1, the present invention is directed to a load transporting system 1 that may be used in connection with various applications, including, but not limited to, mining applications. The inventive load transporting system 1 is intended to move a load carrying structure 100 that may support a load along the vertical direction, i.e., upwards or downwards, for example along a mine shaft, a vertical tunnel, a boring hole, etc. The load carrying structure 100 may be a platform, or alternatively the load itself. It is within the scope of the present invention that the inventive load transporting system 1 maintain a substantially horizontal orientation of a load carrying structure 100 while it is being hoisted, upwards or downwards, along the vertical direction.

Figure 2:
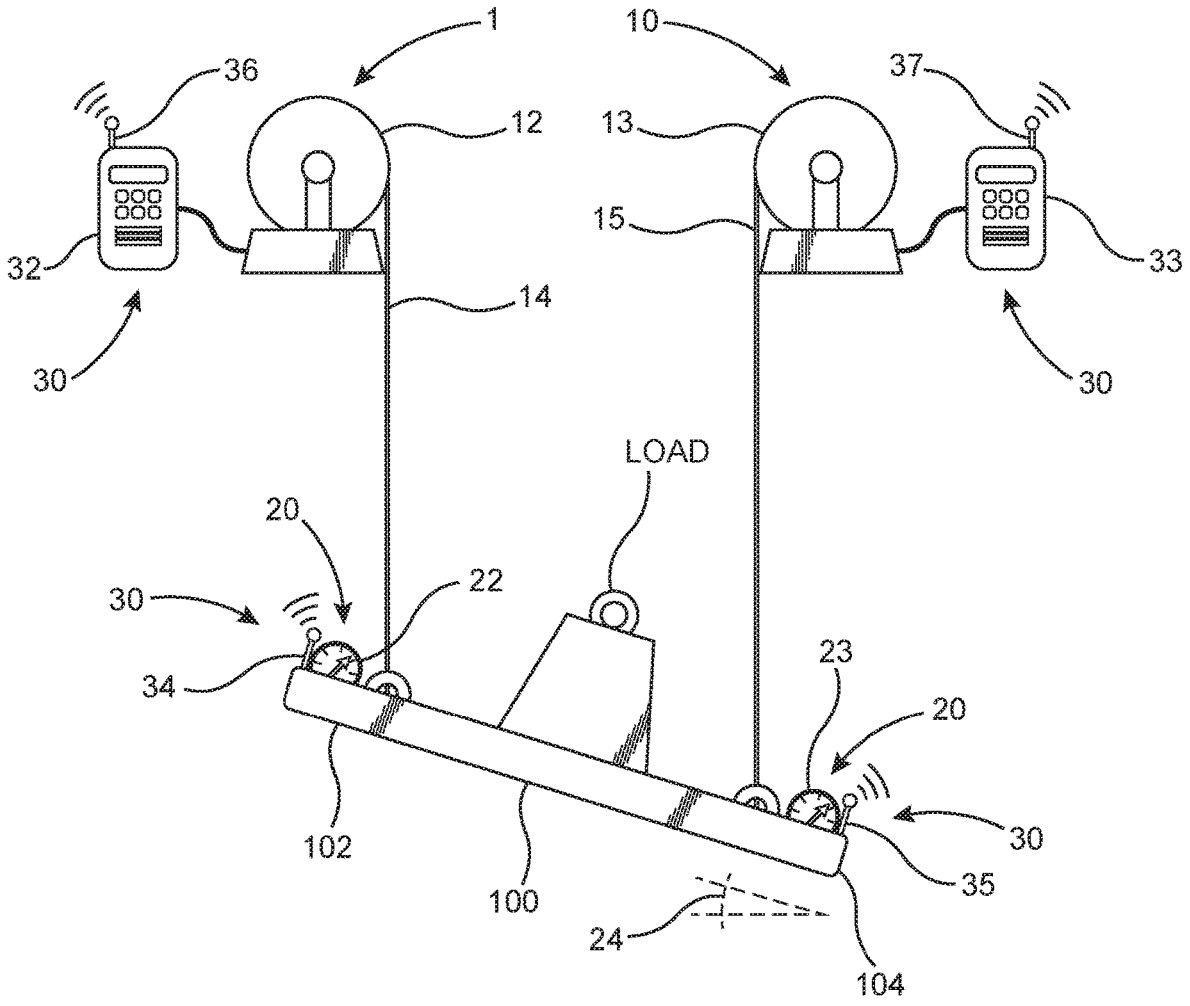
FIG. 2 is a schematic representation of another embodiment of a system according to the present invention with a load carrying structure having an angle of inclination.
Figure 3:
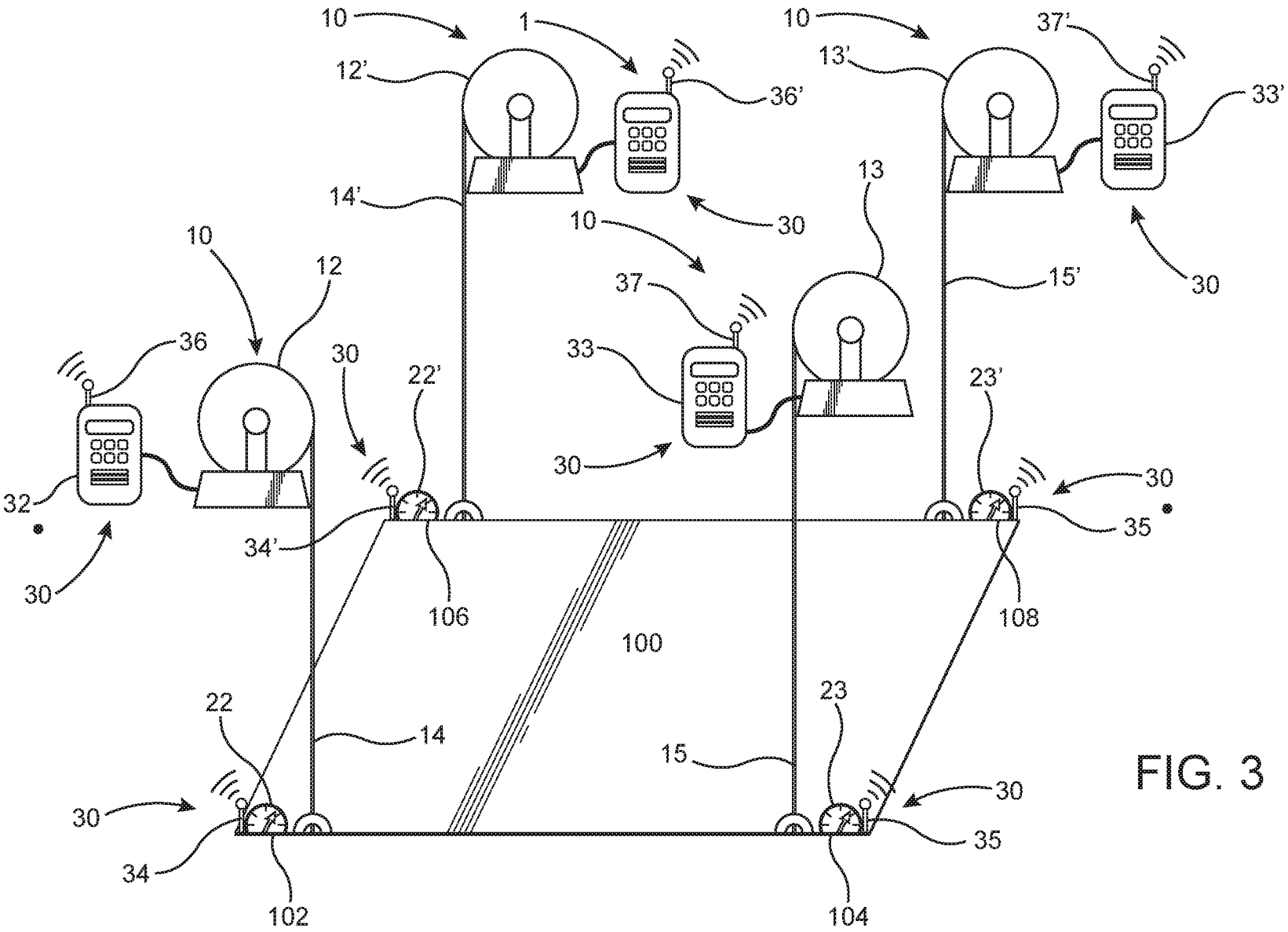
FIG. 3 is a schematic representation of yet another embodiment of a system according to the present invention comprising four lifting devices and four hoist lines connected to a load carrying platform.

With reference to FIGS. 1-3, the inventive load transporting system 1 comprises a lifting assembly 10, a detection assembly 20, and a control assembly 30. The lifting assembly 10 may comprise one or more driving or lifting devices operatively configured with a corresponding hoist line or cable that is connected to the load carrying structure 100. As an example, the driving or lifting device may be a motor winch 12 and/or 13 comprising a drum, which is connected to a hoist line 14 or 15. As such, the hoist line 14 or 15 may be wound or unwound around the lifting device or winch 12 or 13, which when activated controls its vertical movement including an upward/lifting or downward/lowering. As shown in FIGS. 1-2, the inventive load transporting system 1 may comprise the lifting assembly 10 having a first lifting device 12 and a second lifting device 13. Each of the lifting devices 12 and 13 are drivingly connected to a different hoist line respectively indicated as 14 and 15. Each of the hoist lines 14 and 15 is connected to different portions of the load carrying structure 100. As shown in the illustrative embodiments of FIGS. 1-2, a first hoist line 14 may be connected to the load carrying structure 100 generally at a first side or end 102 thereof, wherein the second hoist line 15 may be connected to the load carrying structure 100 generally at a second side or end 104, which may be spaced from and/or substantially opposed to the first cider and 102. As such, the load carrying structure 100 may have two different points of attachments 102 and 104, which may improve the stability of the load carrying structure 100 as well as the load being supported thereon. As set forth herein, the number of attachment points is not limited to just two attachment points 102 and 104. An additional number of attachment points may also be implemented dependent, at least in part, on the size and/or configuration of the load carrying structure 100, as well as the size, weight and configuration of the load being supported. Further, the plurality of attachment points, regardless of their number, should be relatively disposed to efficiently, effectively and accurately maintain a substantially level or horizontal orientation of the load supporting structure 100 during the vertical movement (lifting or lowering) of the load carrying structure 100 and the load being supported thereon.

The illustrative embodiment as shown in FIG. 1 shows a load carrying structure 100 having a substantially level or horizontal orientation. Conversely, the illustrative embodiment as represented in FIG. 2 shows a load carrying structure 100 with an angle of inclination 24. As represented, the inventive system 1 comprises a detection assembly 20, which is intended to determine an angle of inclination 24, which is determinative of the load caring structure 100 not being level or disposed in a horizontal orientation. Such an undesirable angle of inclination 24 may occur as the load carrying structure 100 is being either raised or lowered along an intended vertical path of travel such as, but not limited to, along the mine shaft, vertical tunnel, etc. as also represented, the detection assembly 20 may comprise at least one inclinometer configured to determine an angle of inclination 24 of the load carrying structure 100 with respect to a horizontal plane. In the illustrative embodiments of FIGS. 1-2, a detection assembly 20 is shown comprising a first inclinometer 22 and a second inclinometer 23. The inclinometer(s) may be disposed on an intended location of the load carrying structure 100, where it may be desirable or more effective to ascertain an angle of inclination 24. For example, the first inclinometer 22 may be disposed on a first side or end 102 of the load carrying structure 100. The first inclinometer 22 may or may not be disposed in proximity to the first hoist line 14. Also, as an example, the second inclinometer 23 may be disposed around a second side or end 104 of the load carrying structure 100. The second inclinometer 23 may or may not be disposed in close proximity the second hoist line 15.

The control assembly 30 may comprise at least one control device, at least one transmitter, and at least one receiver. In more specific terms and as represented in FIGS. 1-2, one embodiment of the present invention includes the control assembly 30 comprising a first control device 32 and a second control device 33, a first transmitter 34 and a second transmitter 35, and a first receiver 36 and a second receiver 37. Each one of the control devices 32 and 33 is operatively connected to a corresponding receiver 36 or 37. In at least one embodiment, each or at least one control device may be a Variable Frequency Drive, typically known as a VFD. Each one of the control devices 32 and 33 is also operatively connected to a corresponding lifting device 12 or 13. The transmitters 33 and 35 may be disposed on the load carrying structure 100, generally in operative relation to a corresponding inclinometer 22 or 23. However, the location of each of the transmitters 33, 35, etc. relative to the corresponding inclinometers 22, 23, etc. may vary to the extent of still maintaining an operative association there with. Similarly, the control devices 32, 33, etc. and corresponding receivers 36, 37, etc. may be disposed in an operative, communicating relation to the corresponding lifting devices 12, 13, etc. which will assure operative communication therebetween. By way of non-limiting example, the receivers 36, 37, etc. and corresponding ones of the control devices 32, 33, etc. may be practically disposed above or at a higher elevation than the load carrying structure 100. Thus, the control devices 32 and 33 may be configured to adjust the operative speed and direction of rotation (lifting or lowering) of a corresponding lifting device 12 and 13, thereby determinatively adjusting the rate of movement of a corresponding hoist line 14 and 15 and the links thereof extending between the corresponding lifting device 12 and 13 and the load carrying structure 100. In turn, the length of each of the one or more hoist lines 14, 15, etc. between the lifting device 12 and 13 and the load carrying structure 100 will be such as to establishing and maintain a substantially level or horizontal orientation of the load carrying structure 100, and the stability of the load being supported thereon. For example, the control devices 32 and 33 may be configured to adjust a velocity of a corresponding hoist line 14 and/or 15 as the vertical movement, in either direction, of each one is controlled by a lifting device 12 and or 13. Such adjustment in the velocity of the hoist lines 14 and/or 15, should be such as to determine the velocity of the load carrying structure 100, while concurrently maintaining it in the aforementioned substantially level or horizontal orientation.

Each inclinometer 22 and 23, as represented in the embodiment of FIGS. 1 and 2, is generally operatively connected to a corresponding transmitter 34 and/or 35. If either or both of the inclinometers 22 and/or 23 ascertain an angle of inclination 24 of the load carrying structure 100 that exceeds a predetermined or threshold value, which is indicative of a level or horizontal orientation of the load carrying structure 100, and associated or corresponding one of the transmitters 34 and/or 35 may transmit a signal to a corresponding receiver 36 and/or 37. When the receivers 36 and/or 37 obtain such a signal from the transmitters 34 and/or 35, for example, indicating that a true angle of inclination 24 of the load carrying structure 100 has deviated from the preferred predetermined angle of inclination of 0°, the control devices 32 and/or 33 may be activated/operated to adjust the speed of operation of the corresponding lifting device 12 and/or 13 thereby regulating and determining the length of the corresponding hoist lines 14 and/or 15, which corresponds to a substantially level or horizontal orientation of the load caring structure. With reference to the embodiment of FIGS. 1 and 2 and for the purposes of illustration, the following example of the load transporting system 1 according to the present invention comprises a load carrying structure 100 which may be vertically lifted or lowered. In this example, the inventive system 1 comprises a lifting assembly 10 with a first lifting device 12 and a second lifting device 13. The first lifting device 12 is connected to a first hoist line 14, whereas the second lifting device 13 is connected to a second hoist line 15. The load transporting system 1 further comprises a detection assembly 20 comprising at least one but preferably at least a first inclinometer 22 and a second inclinometer 23. The load transporting system also comprises a control assembly 30 including a first control device 32 and a second control device 33, a first transmitter 34 and a second transmitter 35, and a first receiver 36 and a second receiver 37. The first hoist line 14 and second hoist line 15 are movable by the corresponding lifting devices 12 and 13, respectively and are concurrently connected in supporting relation to the load carrying structure 100. As indicated, the lifting devices 12 and 13 and may enable a vertical movement of the load carrying structure 100 as it moves upwards and/or downwards. More specifically, the first hoist line 14 may be connected to and control movement of the load carrying structure 100 adjacent a first side or end 102, whereas the second hoist line may be connected to and control movement of the load carrying structure 100 adjacent a second side or end 104 thereof. Initially, the load carrying structure 100 may be disposed and maintain in a substantially level or horizontal orientation when moving upwards or downwards. However, as the vertical displacement of the load carrying structure 100 occurs, it may develop an undesirable angle of inclination 24, relative to the horizontal plane and its preferred level or horizontal orientation, as represented in FIG. 2. This may occur because of a different speed of operation of the two separate lifting devices 12 and 13, as well as other possible reasons. Different operational characteristics of the lifting devices 12 and 13 may occur even if they are the same model or are built to the same specifications.

In addition, other possible reasons for a variation in the load caring structure 100 assuming a non-level orientation may include, but are not limited to, elongation of the different hoist lines 14 and 15, even if they are of same type and structure. Also, the load being supported by the load caring structure 100 may not be centered, resulting in a faster rate of operation of one lifting device 12 or 13, or the elongation of the hoist line 14 or 15 closest to the off centered load on the load caring structure 100. Also, the hoist lines being wound or unwound from a given winch may be at different wound "layers" of the hoist line on the drum of the respective winch. Therefore, even when the different winches 12 and 13 are operating at the same rotational speed, the winding or unwinding (lifting or lowering) of the hoist lines 14 and 15 may differ. Accordingly, the load carrying structure 100 may develop an angle of inclination 24 with respect to the horizontal plane that may differ from a predetermined threshold value.

It is emphasized herein that the terms "predetermined angle of inclination" and "predetermined threshold value" are meant to define an angle of inclination of the load carrying structure 100 which approximates 0°, where in a 0° angle of inclination of the support structure 100 is indicative of a substantially level or horizontal orientation of the load carrying structure 100. It is further emphasized that the level or substantially horizontal orientation of the load carrying structure 100 does not have to assume a precisely 0° angle of inclination. Minor variations from a 0° angle of information may still result in a sufficiently level or horizontal orientation of the load carrying structure 100 necessary to maintain a stability of the load being supported on the load caring structure 100 during vertical travel.

With further reference to FIG. 2, the load carrying structure 100 may develop an angle of inclination 24 that notably exceeds the predetermined threshold value (such as a 0°), such that the first control device 32 may regulate operation of the first lifting device 12 to adjust the speed of the first hoist line 14. More specifically, if the first angle of inclination 24 exceeds such predetermined or threshold value, such that the first end 102 of the load carrying structure 100 is at a higher elevation than the second end 104, this would generally mean that the second hoist line 15 has traveled a longer vertical distance than the first hoist line 14.

If the load caring structure 100 is being lifted or raised by the two hoist lines 14 and 15, overcoming the angle of inclination 24 would be accomplished by decreasing the speed of operation of the corresponding winch 12, associated with hoist line 14, or increasing the speed of operation of the winch 13 associated with the hoist line 15. Yet another alternative would be a concurrent decrease in the speed of operation of winch 12 and an increase in the speed of operation of the winch 13, thereby adjusting the lengths of the hoist lines 14 and 15 at the same time, until a substantially level orientation of the load carrying structure 100 has been established.

The opposite would occur if the load carrying structure 100 is being lowered by the two hoist lines 14 and 15. More specifically, if the load caring structure 100 is being lowered and an undesirable angle of inclination 24 occurs, as represented in FIG. 2, the speed of operation of the corresponding winch 12, associated with hoist line 14, would be increased or the speed of operation of the winch 13 associated with the hoist line 15 would be decreased. In the alternative, correction of the inclination angle 24 could be corrected by a concurrent increase in the speed of operation of winch 12 and a decrease in the speed of operation of the winch 13. Such a concurrent control of the winches 12 and 13 would adjust the lengths of the hoist lines 14 and 15 at the same time, until a substantially level orientation of the load carrying structure 100 has been established.

As set forth above, when the receivers 36 and/or 37 obtain a signal from the transmitters 34 and/or 35, indicating that an angle of inclination 24 of the load carrying structure 100 has deviated from the preferred predetermined angle of inclination of 0°, the control devices 32 and/or 33 may be manually or otherwise activated to adjust the speed of operation of the corresponding lifting device 12 and/or 13. This in turn results regulating the length of the corresponding hoist lines 14 and/or 15 by regulating the speed of the corresponding winches 12 and 13. In the above set forth alternative, wherein the operative speed of winches 12 and 13 are concurrently adjusted thereby adjusting the length of the corresponding hoist lines 14 and 15 at the same time, the present invention may incorporate yet another structural and operative modification. More specifically, each of the control devices 32 and 33 may incorporate predetermined "control circuitry" that simultaneously inverts the commands sent to lifting devices or winches 12 and 13. By way of example, when pushing the up button or down button on either the control devices 32 or 33 the lifting devices or winches 12 and 13 will be concurrently activated to operate in a reversed direction. This in turn will concurrently vary the lengths of the hoist lines 14 and 15 resulting in the angle of inclination 24 assuming the preferred inclination angle of 0° and substantially leveling the load caring structure 100. As should also be apparent, both of the lifting devices or winches 12 and 13 can be operated from a single control device (not shown) rather than a plurality of such control devices 32, 33, etc.

With reference to FIG. 3, additional features of the present invention comprise providing system 1 with a lifting assembly 10 having a plurality of at least four separate lifting devices and associated components. As shown in FIG. 3 the lifting assembly 10 may comprise four lifting devices, indicated as 12, 12', 13, and 13'. Each lifting device 12, 12', 13, and 13' may be connected to, and configured to control the movement of, a corresponding hoist line 14, 14', 15, and 15'. In turn each hoist line 32, 32', 33 and 33' may be connected to a corresponding end 102, 106, 104 and 108 of the load carrying structure 100. Having four different points of attachment may be advantageous to further provide stability to the load carrying structure 100. Accordingly, the system 1 may also comprise a detection assembly 20 with four inclinometers 22, 22', 23, and 23'. A control assembly 30 may also be provided with four control devices 32, 32', 33 and 33', four transmitters 34, 34', 35 and 35', and four receivers 36, 36', 37 and 37'. It is within the scope of the present invention that the four control devices 32, 32', 33 and 33' be configured to independently adjust movement of a corresponding hoist line 32, 32', 33 and 33' upon the angle of inclination 24 exceeding a predetermined or threshold value. For example, the load carrying platform 100 may develop an angle of inclination with respect to the horizontal plane along the X-axis, e.g., in the direction from side 102 to 104, or from side 106 to 108. The load carrying structure 100 may also develop an angle of inclination with respect to the horizontal plane along the Z-axis, i.e., in the direction from side 102 to 106, or from side 104 to 108. Accordingly each control device 32, 32', 33 and 33', may control operation of a desired corresponding lifting device 12, 12', 13, and 13' to independently adjust the speed of a corresponding hoist line 14, 14', 15, and 15'.

Since many modifications, variations and changes in detail can be made to the described preferred embodiment of the invention, it is intended that all matters in the foregoing description and shown in the accompanying drawings be interpreted as illustrative and not in a limiting sense.

Thus, the scope of the invention should be determined by the appended claims and their legal equivalents.

What is claimed is:

1. A load transporting system comprising:

a lifting assembly comprising:

at least a first lifting device connected to a load carrying structure via a first hoist line, said first lifting device configured to control movement of said first hoist line in a substantially vertical direction, a detection assembly comprising:

at least a first inclinometer disposed on said load carrying structure and configured to determine an angle of inclination of said load carrying structure, a control assembly comprising:

a first control device operatively associated with said at least first lifting device, a first transmitter operatively associated with said at least first inclinometer, a first receiver operatively associated with said first transmitter and said first control device, and said first control device configured to adjust a speed of operation of said first hoist line upon said angle of inclination of said load carrying structure exceeding a predetermined angle of inclination.

2. The load transporting system as recited in claim 1 wherein said lifting assembly further comprises a second lifting device connected to said load carrying structure via a second hoist line, said second lifting device configured to control movement of said second hoist line a substantially vertical direction.

3. The load transporting system as recited in claim 2 wherein said second lifting device is a motorized winch.

4. The load transporting system as recited in claim 2 wherein said detection assembly further comprises a second inclinometer disposed on said load carrying structure; said second inclinometer configured to determine said angle of inclination of said load carrying structure.

5. The load transporting system as recited in claim 4 wherein said control assembly further comprises: a second control device operatively associated with said second lifting device, a second transmitter disposed on said load carrying structure, and a second receiver operatively associated with said second transmitter and said second control device.

6. The load transporting system as recited in claim 5 wherein said second transmitter is operatively associated with said second inclinometer.

7. The load transporting system as recited in claim 5 wherein at least one of said first and second control devices comprises a variable frequency drive.

8. The load transporting system as recited in claim 5 wherein said second control device is configured to adjust a speed of operation of said second lifting device upon said angle of inclination of said load carrying structure exceeding said predetermined angle of inclination.

9. The load transporting system as recited in claim 1 wherein said first lifting device is a motorized winch.

10. The load transporting system as recited in claim 1 wherein said predetermined angle of inclination is substantially 0°.

11. The load transporting system as recited in claim 1 wherein said first transmitter is operatively associated with said first inclinometer.

12. A load transporting system comprising:

a lifting assembly comprising:

a first and a second lifting device each one connected to a load carrying structure respectively via a first and a second hoist line, said first and second lifting devices configured to independently control movement respectively of said first and second hoist lines in a substantially vertical direction, a detection assembly comprising:

a first inclinometer disposed on said load carrying structure and configured to determine a first angle of inclination of a first portion of said load carrying structure, a second inclinometer disposed on said load carrying structure and configured to determine a second angle of inclination of a second portion of said load carrying structure, a control assembly comprising:

a first and a second control device each operatively associated respectively with said first and second lifting devices, a first transmitter operatively associated with said first inclinometer, a second transmitter operatively associated with said second inclinometer, a first receiver operatively associated with said first transmitter and said first control device, a second receiver operatively associated with said second transmitter and said second control device, and said first and second control devices each configured to independently adjust movement of said first and second hoist lines respectively, upon said first and second angle of inclinations of said load carrying structure exceeding a predetermined angle of inclination.

13. The load transporting system as recited in claim 12 wherein said first inclinometer is disposed on a first portion of said load carrying structure.

14. The load transporting system as recited in claim 12 wherein said second inclinometer is disposed on a second portion of said load carrying structure in spaced relation to said first inclinometer.

15. The load transporting system as recited in claim 12 wherein said first lifting device is configured to adjust a speed of said first hoist line upon said first angle of inclination exceeding said predetermined angle of inclination.

16. The load transporting system as recited in claim 12 wherein said first lifting device is configured to adjust the speed of said first hoist line upon said first angle of inclination falling below said predetermined angle of inclination.

17. The load transporting system as recited in claim 12 wherein said second lifting device is configured to adjust a speed of said second hoist line upon said second angle of inclination exceeding said predetermined angle of inclination.

18. The load transporting system as recited in claim 12 wherein said second lifting device is configured to adjust the speed of said second hoist line upon said second angle of inclination falling below said predetermined angle of inclination.

19. A load transporting system comprising:

a lifting assembly comprising:

at least two lifting devices each one connected to a load carrying structure respectively via a corresponding hoist line, a first and second lifting device configured to independently control movement of said corresponding hoist lines in a substantially vertical direction, a detection assembly comprising:

at least two inclinometers each one disposed on said load carrying structure and configured to determine an angle of inclination of said load carrying structure, a control assembly comprising:

at least two control devices each one operatively connected to a corresponding one of said at least two lifting devices, at least two transmitters each one operatively connected to a corresponding one of said at least two inclinometers, at least two receivers each one operatively connected to a corresponding one of said at least two transmitters and to a corresponding one of said at least two control devices, and said at least two control devices configured to independently adjust movement of said corresponding hoist lines, upon said angle of inclination of said load carrying structure deviating from a predetermined angle of inclination.

20. The load transporting system as recited in claim 19 wherein said predetermined angle of inclination is substantially 0°.

* * * * *